US006976824B2

(12) United States Patent
Nottin

(10) Patent No.: US 6,976,824 B2
(45) Date of Patent: Dec. 20, 2005

(54) REDUCING CLEARANCE IN A GAS TURBINE

(75) Inventor: Claude Nottin, Saint Sauveur sur Ecole (FR)

(73) Assignee: Snecma Moteurs, Paris (FR)

( * ) Notice: Subject to any disclaimer, the term of this patent is extended or adjusted under 35 U.S.C. 154(b) by 0 days.

(21) Appl. No.: 10/825,320

(22) Filed: Apr. 16, 2004

(65) Prior Publication Data

US 2005/0008481 A1 Jan. 13, 2005

(30) Foreign Application Priority Data

Apr. 16, 2003 (FR) ..... 03 047360

(51) Int. Cl.[7] ..... F01D 11/12; F01D 11/16

(52) U.S. Cl. ..... 415/115; 415/173.1; 415/173.3; 415/173.4; 415/173.5; 416/97 R

(58) Field of Search ..... 415/173.1, 173.2, 415/173.3, 173.4, 173.5, 173.6, 115–116; 416/96 R, 96 A, 97 R; 418/148

(56) References Cited

U.S. PATENT DOCUMENTS 3,117,716 A 1/1964 Wernicke
3,547,455 A * 12/1970 Daunt ..... 415/173.4
4,336,276 A * 6/1982 Bill et al. ..... 415/173.4
4,411,597 A * 10/1983 Koffel et al. ..... 416/97 R
4,424,001 A * 1/1984 North et al. ..... 416/97 R
5,037,273 A * 8/1991 Krueger et al. ..... 415/173.6

FOREIGN PATENT DOCUMENTS

| | | |
|---|---|---|
| DE | 195 31 561 | 3/1997 |
| EP | 1 267 037 | 12/2002 |
| FR | 2 502 242 | 9/1982 |
| FR | 2 640 701 | 6/1990 |
| GB | 1 107 024 | 3/1968 |
| GB | 2 106 997 | 4/1983 |
| JP | 62-142805 | 6/1987 |

* cited by examiner

*Primary Examiner*—Christopher Verdier
(74) *Attorney, Agent, or Firm*—Oblon, Spivak, McClelland, Maier & Neustadt, P.C.

(57) ABSTRACT

A gas turbine, in particular a high pressure turbine for an airplane engine, the turbine comprising moving blades (10) with tips that are fitted with radially slidable stubs (26) for being pressed in operation by centrifugal forces against the inside surface of the casing (16) of the turbine in order to eliminate radial clearance between said surface and the tips of the blades (10).

14 Claims, 3 Drawing Sheets

Fig. 1
PRIOR ART
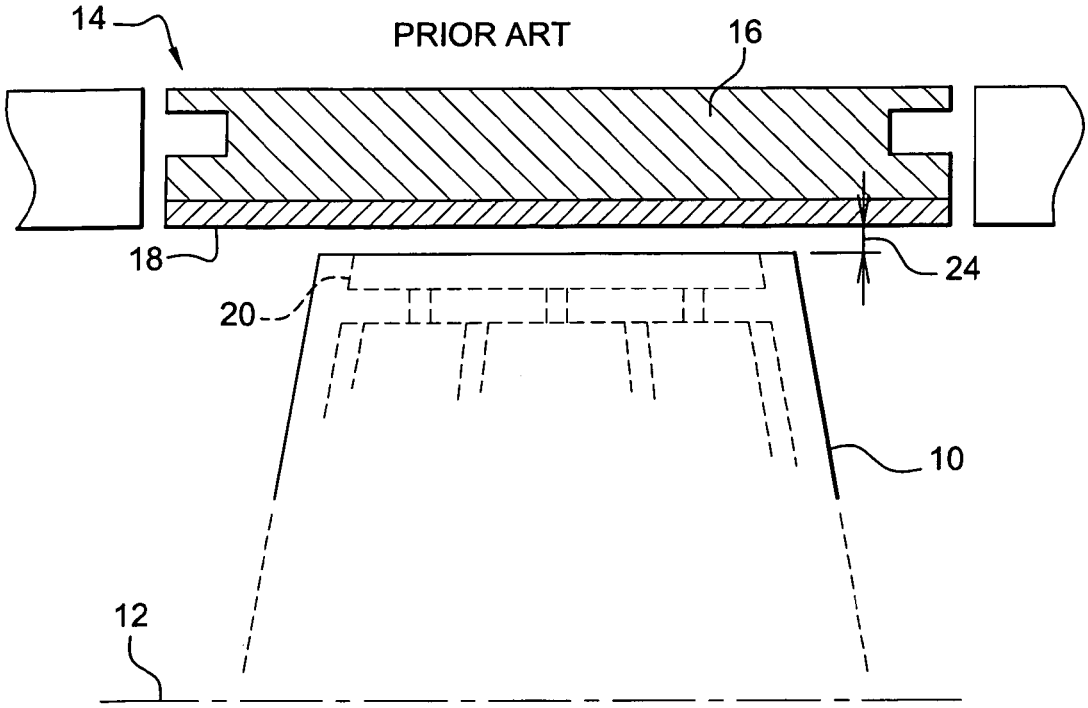
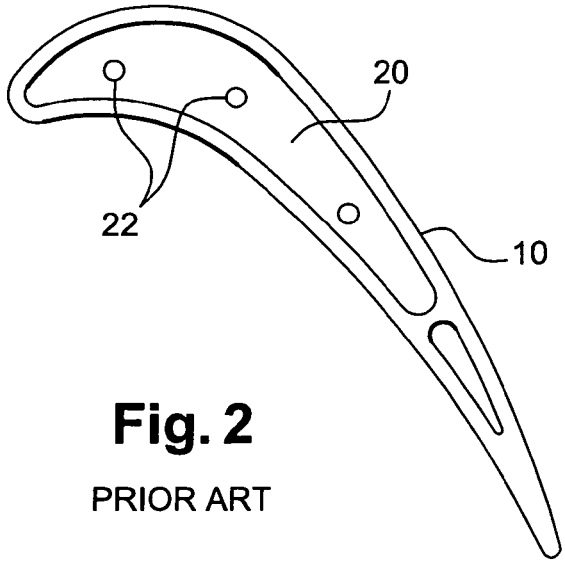
Fig. 2
PRIOR ART

REDUCING CLEARANCE IN A GAS TURBINE

The invention relates essentially to means for reducing clearance between the tips of moving blades and the inside surface of the casing of a gas turbine, in particular a high pressure turbine for an airplane engine.

In this type of turbine, it is known to fix peripheral stubs to the tips of the blades in order to limit radial clearance between the tips of the blades and a layer of abradable material carried by a ring fixed to the casing of the turbine. The stubs may include circumferential ribs or wipers which come substantially into contact with the abradable material in order to provide axial sealing between the casing and the tips of the moving blades.

The drawbacks of such peripheral stubs is that they form additional mass at the periphery of the turbine wheel, which mass is subjected to centrifugal forces in operation and leads to problems of mechanical strength and of vibration behavior in the moving blades.

Eliminating such stubs requires the above-mentioned radial clearance to be reduced on assembly (clearance when cold), with a risk of contact between the tips of the blades and the casing in operation and with a corresponding risk of the turbine being damaged, or else it requires clearance to be controlled actively by means which are expensive, heavy, and difficult to control. Otherwise, the radial clearance between the tips of the blades and the casing can be relatively large, which gives rise to a corresponding degradation in the performance of the turbine.

In addition, this radial clearance can vary locally between a minimum value and a maximum value, e.g. due to ovalization of the casing, to a difference in heights between blades, to a lack of concentricity between the casing and the turbine wheel, etc.

A particular object of the invention is to provide a solution to these problems that is simple, satisfactory, and of low cost.

To this end, the invention provides a gas turbine, in particular for an airplane engine, the turbine comprising a wheel mounted to rotate in a casing and carrying blades whose tips are at a small radial distance from an inside surface of the casing, and means for reducing clearance between the tips of the blades and the inside surface of the casing, the turbine being characterized in that the means for reducing clearance comprise stubs mounted in radially slidable manner to the tips of the blades and guided in an annular groove of the casing.

In the turbine of the invention, when the turbine wheel is set into rotation, the stubs are automatically urged towards the inside surface of the casing by centrifugal forces without it being necessary to exert any force on the blades of the wheel. This avoids the mechanical vibration problems encountered in turbines having moving blades fitted with stationary peripheral stubs, and the performance of the turbine is improved by eliminating radial clearance between the tips of the blades and the inside surface of the casing.

According to another characteristic of the invention, the stubs are made of a material that is lightweight and withstands wear and high temperatures, which material is preferably a ceramic.

This ensures that axial sealing between the tips of the blades and the inside wall of the casing is maintained over time, and that the performance of the turbine is maintained over time.

According to yet another characteristic of the invention, each of the above-mentioned stubs includes a curved plate for extending along the inside surface of the casing.

The curved plate has a surface above the surface of the blade tip on which it is mounted, thereby further improving the above-mentioned axial sealing between the tips of the blades and the inside surface of the casing.

Advantageously, at least two circumferential parallel ribs forming wipers are presented by the face of said plate that faces towards the inside face of the casing.

These wipers further reduce the air flow section between the tips of the blades and the inside surface of the casing.

In a first embodiment of the invention, each above-mentioned stub is engaged at least in part in a bathtub formed in the tip of the blade.

In which case, the stub advantageously co-operates with the walls of the bathtub to define cooling air flow passages which are fed from channels that open out into the bottom of the bathtub via de-dusting orifices.

In another embodiment of the invention, applicable when the blades do not have bathtubs at their tips, each above-mentioned stub is engaged on the tip of the blade.

The invention is applicable to turbines whose casing inside surfaces define streams of constant cylindrical section or of diverging cylindrical section.

The invention will be better understood and other characteristics, details, and advantages thereof will appear more clearly on reading the following description made by way of example and given with reference to the accompanying drawings, in which:

FIG. 1 is a fragmentary diagrammatic axial section view showing the radial clearance between the tip of a moving blade and the inside cylindrical surface of a turbine casing;

FIG. 2 is a plan view of the tip of the FIG. 1 blade;

Figure 3:
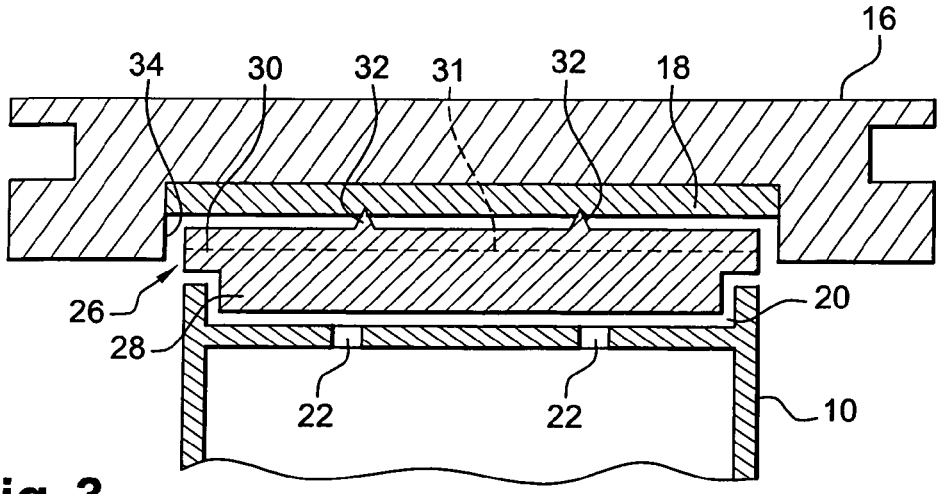
FIG. 3 is a fragmentary diagrammatic axial section view of a first embodiment of the invention.
Figure 4:
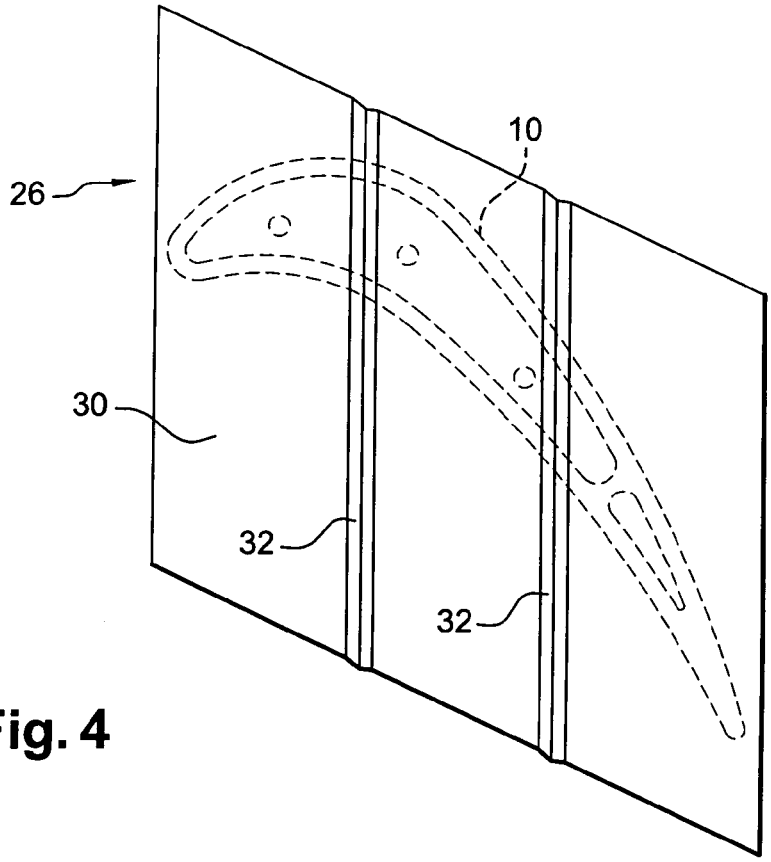
FIG. 4 is a plan view of the tip of the FIG. 3 blade.
Figure 5:
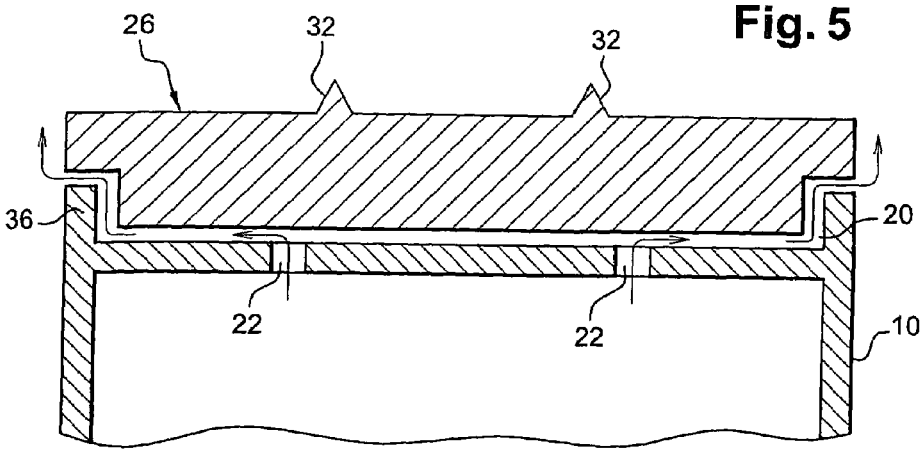
Figure 6:
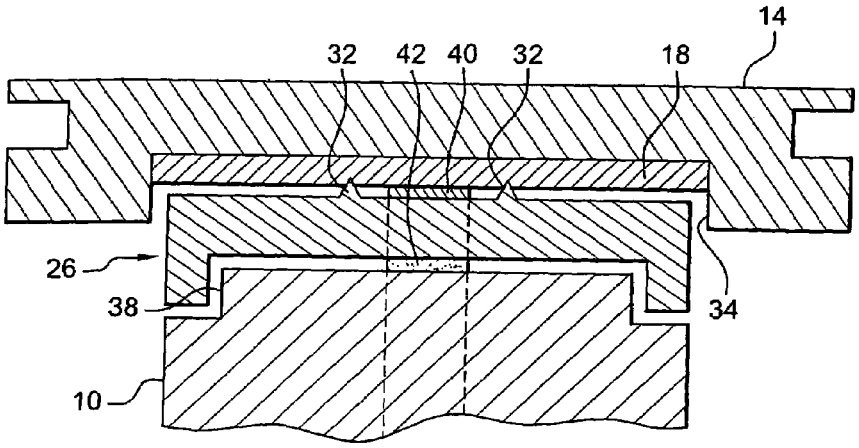
Figure 7:
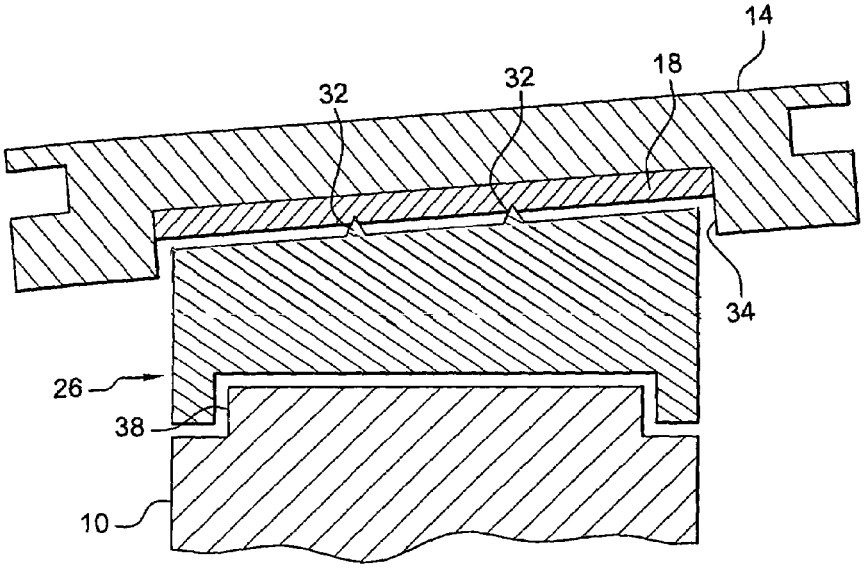

FIG. 5 is a fragmentary diagrammatic axial section view on a larger scale of the tip of the blade of FIGS. 3 and 4; and FIG. 6 is a fragmentary diagrammatic axial section view of a variant embodiment of the invention, the turbine casing having a cylindrical inside surface; and FIG. 7 is a fragmentary diagrammatic axial section view of another variant embodiment of the invention, the turbine casing having a divergent inside surface.

Reference is made initially to FIGS. 1 and 2 which are diagrams showing the art prior to the present invention, with reference 10 designating a blade of a high pressure turbine wheel mounted to rotate about an axis 12 in a casing 14 comprising a stationary metal ring 16 surrounding the turbine wheel and having an inside cylindrical surface covered in a layer 18 of an abradable material of a type that is well known in the art.

The tip of the blade 10 is situated at a very small distance from the layer 18 of abradable material and it includes a cavity referred to as a "bathtub" in the art, with the bottom of the cavity including de-dusting orifices 22 constituting outlets for cooling air flow ducts that are formed in the blade 10.

As mentioned above, the radial clearance 24 between the tip of the blade 10 and the layer 18 of abradable material that forms the inside surface of the casing must be as small as possible in order to avoid any deterioration in the performance of the turbine.

For this purpose, and as shown in FIGS. 3 to 5, the invention proposes mounting a peripheral stub 26 that is radially slidable at the tip of the blade 10, the peripheral stub 26 being partially inserted or received in the bathtub 20 at the tip of the blade 10.

In the embodiment shown in FIGS. 3 to 5, the stub 26 has a radially inner portion 28 inserted in the bathtub 20 of the base 10 and a radially outer portion 30 in the form of a plate that is curved to constitute a portion of a cylinder and of outline in the form of a parallelogram as can be seen in FIG. 4, which extends along the layer 18 of abradable material at a very small distance therefrom, and which presents an area in the plane of FIG. 4 that is significantly greater than the area of the portion 28 that is inserted in the bathtub 20.

The radially outer face of the plate 30 is formed to have circumferential parallel ribs 32, e.g. two such ribs as shown, with the tips of the ribs being in contact with the layer 18 of abradable material and co-operating therewith to form a labyrinth seal to prevent any flow of air in the axial direction between the plate 30 and the layer 18 of abradable material while the turbine is in operation.

The stub 26 mounted at the end of the blade 10 is received in part and is guided in an annular groove 34 in the ring 16, with the layer 18 of abradable material being disposed in the bottom thereof. This configuration holds the stub 30 in place at the end of the blade 10 both axially and radially.

The stubs 26 are preferably made of a material that is lightweight and that withstands wear, and that also withstands high temperatures, said material being, in particular, a ceramic.

In operation, the stubs 26 are rotated about the axis of the turbine together with the blades 10 and they are subjected to centrifugal forces which press them against the layer 18 of abradable material.

The pressure of the tips of the ribs 32 against the layer 18 leads to elimination of the radial clearance for passing air in an axial direction between the tips of the blades 10 and the inside surface of the casing, thereby increasing the performance of the turbine. This pressure of the stubs 26 against the layer 18 leads to no extra force on the blades 10.

Furthermore, the sliding mount of the stubs 26 on the tips of the blades automatically accommodates geometrical defects of the blades and of the ring, e.g. due to the casing being ovalized, to differences in height between the blades, to the casing being disposed eccentrically, to the turbine wheel being disposed eccentrically, etc. . . . .

As shown in FIG. 5, the air for cooling the blade 10 which escapes via the de-dusting orifices formed in the bottom of the bathtub 20 flows along passages that are formed between the stubs 26 and the side walls 36 of the bathtub thus contributing to cooling said walls.

In the variant embodiment of FIG. 6, the tip of the blade 10 does not include a bathtub, in which case the peripheral stub 26 is engaged on the tip of the blade 10, e.g. being fitted as a cap on a peripheral rib 38 at the tip of the blade.

As before, the stub 26 has wipers 32 on its radially outer face and it is guided and retained in an annular groove 34 of the ring 14.

In a variant, the means for inserting or engaging stubs 26 on the tips of the blades 10 are dimensioned and shaped in a manner suitable on their own for avoiding any risk of the stub becoming disengaged. Under such circumstances, the annular grooves 34 formed in the inside surface of the casing provide an additional guarantee that the stubs will be retained, and could optionally be omitted.

The plates 30 forming the radially outer portions of the stubs 26 may occupy a greater or lesser extent relative to the dimensions of the tips of the blades 10, and where necessary the plates 30 could include reinforcement 31, e.g. made of metal, for stiffening purposes.

For mounting purposes, the stubs 26 may be held on the tips of the blades by adhesive 42 or by a tie such as a hoop or a band 40 surrounding the stubs 26 and the ring of blades.

What is claimed is:

1. A gas turbine, comprising:

a wheel mounted to rotate in a casing and carrying blades whose tips are at a small radial distance from an inside surface of the casing, and means for reducing clearance between the tips of the blades and the inside surface of the casing, wherein the means for reducing clearance comprise stubs mounted in radially slidable manner to the tips of the blades and guided in an annular groove of the casing.

2. A gas turbine according to claim 1, wherein the stubs are made of a material that is lightweight and withstands wear and high temperatures.

3. A gas turbine according to claim 1, wherein the stubs are made of ceramic.

4. A gas turbine according to claim 1, wherein the stubs include radially outer portions in the form of curved plates for extending along the inside surface of the casing.

5. A gas turbine according to claim 4, wherein the radially outer portions in the form of plates of the stubs include stiffening reinforcements.

6. A gas turbine according to claim 1, wherein each stub includes parallel circumferential ribs forming wipers on its face facing towards the inside face of the casing.

7. A gas turbine according to claim 1, wherein the inside surface of the casing facing the stubs includes a layer of abradable material.

8. A gas turbine according to claim 1, wherein the stubs are fitted onto the tips of the blades.

9. A gas turbine according to claim 1, wherein the stubs are inserted at least in part in bathtubs formed at the tips of the blades.

10. A gas turbine according to claim 9, wherein the stubs co-operate with walls of the bathtubs to define cooling air flow passages which are fed by channels that open out into bottoms of the bathtubs.

11. A gas turbine according to claim 1, further comprising means for holding the stubs axially and radially on the tips of the blades.

12. A gas turbine according to claim 1, wherein, for assembly purposes, the stubs are held on the tips of the blades by adhesive or by a tie surrounding the blades.

13. A gas turbine according to claim 1, wherein the inside surface of the casing facing the stubs is cylindrical, being divergent or of constant section.

14. A gas turbine according to claim 1, wherein said gas turbine is for an airplane engine.

* * * * *

UNITED STATES PATENT AND TRADEMARK OFFICE

CERTIFICATE OF CORRECTION

PATENT NO. : 6,976,824 B2
DATED : December 20, 2005
INVENTOR(S) : Nottin

It is certified that error appears in the above-identified patent and that said Letters Patent is hereby corrected as shown below:

Title page,
Item [30], Foreign Application Priority Data, should read:
-- Apr. 16, 2003 (FR) ..... 03 04736 --.

Signed and Sealed this

Twenty-eighth Day of February, 2006

JON W. DUDAS
*Director of the United States Patent and Trademark Office*